US008549866B2

(12) United States Patent
Hummrich

(10) Patent No.: US 8,549,866 B2
(45) Date of Patent: Oct. 8, 2013

(54) COOLING TUNNEL AND METHOD FOR OPERATING THE SAME

(75) Inventor: Stefan Hummrich, Lichtenfels (DE)

(73) Assignee: airinotec GmbH, Bayreuth (DE)

( * ) Notice: Subject to any disclaimer, the term of this patent is extended or adjusted under 35 U.S.C. 154(b) by 309 days.

(21) Appl. No.: 12/908,882

(22) Filed: Oct. 21, 2010

(65) Prior Publication Data

US 2011/0030393 A1 Feb. 10, 2011

Related U.S. Application Data

(63) Continuation of application No. PCT/EP2009/054722, filed on Apr. 21, 2009.

(30) Foreign Application Priority Data

Apr. 21, 2008 (DE) ..... 10 2008 019 903

(51) Int. Cl.

| | |
|---|---|
| ***F25D 13/06*** | (2006.01) |
| ***F25D 17/02*** | (2006.01) |
| ***F25D 25/04*** | (2006.01) |
| ***F25D 25/02*** | (2006.01) |
| ***F25D 21/06*** | (2006.01) |
| ***G05D 23/32*** | (2006.01) |

(52) U.S. Cl.

USPC ..... 62/63; 62/62; 62/374; 62/380; 62/381; 62/155; 62/157; 62/158; 62/440; 62/378; 62/231; 99/327; 99/334; 99/335; 99/468; 99/479; 426/524; 198/580; 198/165.2; 198/465.3; 198/322; 198/370.01; 198/370.02; 198/370.03; 198/370.04; 198/370.05; 198/370.06; 198/370.07; 198/370.08; 198/601; 198/349.95; 198/476; 198/576

(58) Field of Classification Search

USPC ..... 62/62, 63, 374, 380–381, 155, 157, 62/158, 440, 378, 231; 426/524; 198/580, 198/465.2, 465.3, 322, 370.01–370.09, 601, 198/358, 349.1–349.95, 576; 99/327, 334, 99/335, 468, 477, 479

See application file for complete search history.

(56) References Cited

U.S. PATENT DOCUMENTS 2,474,069 A * 6/1949 Silvera ..... 62/382

(Continued)

FOREIGN PATENT DOCUMENTS

DE 10017408 A1 10/2001

(Continued)

OTHER PUBLICATIONS

Search Report for DE 102008019903.6 issued by German Patent Office, dated May 17, 2010.

(Continued)

*Primary Examiner* — Frantz Jules
*Assistant Examiner* — Erik Mendoza-Wilkenfel
(74) *Attorney, Agent, or Firm* — Manfred Beck, P.A.

(57) ABSTRACT

A cooling tunnel includes an infeed port for feeding objects, a discharge port for discharging objects, successive treatment stations for treating the objects with a cooling medium, and a conveyor system for transporting the objects to be cooled from the infeed port to the discharge port, with the conveyor system travelling through the individual treatment stations. The conveyor system has a first section running through several treatment stations, the first section extending from the infeed port to a turnaround station, a second section running through several treatment stations, the second section extending from the turnaround station to the discharge port, as well as a return section, which is arranged before the discharge port and connects a discharge-side zone of the second section with an infeed-side zone of the first section, to selectively either discharge objects or to cool them further. A method for operating a cooling tunnel is also provided.

17 Claims, 4 Drawing Sheets

(56) References Cited

U.S. PATENT DOCUMENTS

| | | | | |
|---|---|---|---|---|
| 3,530,571 | A * | 9/1970 | Perry | 29/563 |
| 3,857,252 | A | 12/1974 | Wight | |
| 5,205,128 | A * | 4/1993 | Richard | 62/63 |
| 5,522,238 | A * | 6/1996 | Miller | 62/374 |
| 6,975,926 | B2 * | 12/2005 | Schanin | 700/296 |
| 2002/0170303 | A1 * | 11/2002 | Clark et al. | 62/206 |
| 2003/0074904 | A1 * | 4/2003 | Miller | 62/63 |

FOREIGN PATENT DOCUMENTS

| | | | |
|---|---|---|---|
| DE | 102005043210 | B3 | 5/2007 |
| EP | 1455151 | B1 | 6/2006 |
| FR | 2228689 | A1 | 12/1974 |
| FR | 2389852 | A1 | 12/1978 |
| FR | 2782786 | A1 | 3/2000 |
| FR | 2793006 | A1 | 11/2000 |
| JP | 08319005 | A | 12/1996 |

OTHER PUBLICATIONS

International Search Report, dated Mar. 24, 2010, and International Preliminary Report on Patentabiliy, dated Oct. 26, 2010, for PCT/EP2009/054722, including English language translations.

* cited by examiner

COOLING TUNNEL AND METHOD FOR OPERATING THE SAME

CROSS-REFERENCE TO RELATED APPLICATIONS

This application is a continuation, under 35 U.S.C. §120, of copending International Application No. PCT/EP2009/054722, filed Apr. 21, 2009, which designated the United States; this application also claims the priority, under 35 U.S.C. §119, of German Patent Application No. DE 10 2008 019 903.6, filed Apr. 21, 2008; the prior applications are herewith incorporated by reference in their entirety.

BACKGROUND OF THE INVENTION

Field of the Invention

The invention generally relates to a cooling tunnel and a method for operating a cooling tunnel. More specifically, the invention relates to a cooling tunnel, including an infeed port for feeding objects to be cooled, a discharge port for discharging the objects, a plurality of successive treatment stations for treating the objects to be cooled with a cooling medium, particularly cooling air, and a conveyor system for transporting the objects to be cooled from the infeed port to the discharge port, with the conveyor system travelling through the individual treatment stations.

Cooling tunnels of the type mentioned above are known from U.S. Pat. No. 2,474,069 A and DE 100 17 408 A1. In the known cooling tunnels, the objects to be cooled, such as milk products stacked on pallets, are moved continuously by a conveyor system from treatment station to treatment station, clocked or synchronized if required, and during this movement, cooled by cooling air blown in from the sides.

Since the simultaneous blowing of cooling air from opposite sides has been found to be not very effective, the objects to be cooled or the pallets must be rotated by 180 degrees along the conveying path or transportation path through the use of a turntable or an alternating air supply must be provided. From a construction perspective, both solutions are expensive.

If objects or batches of objects with different target cooling times or setpoint values for the cooling times are to be cooled in such cooling tunnels, there is the problem that with strict adherence to the target cooling times, objects or batches with shorter target cooling times are often cooled for a longer time than is necessary, resulting in a diminished throughput of the cooling tunnel. As against that, if the throughput is given a higher priority, some objects or batches are necessarily cooled for too short a time, i.e. the actually desired target cooling time is undershot, which may affect the product quality.

Therefore, continuous cooling tunnels are only economical in applications in which the target cooling times of the individual objects do not vary too much from one another. With large throughput quantities, a certain optimization can be achieved through parallel operation of several conveyor lines in one cooling tunnel.

A discontinuous cooling tunnel has been suggested in European Patent Document No. EP 1 455 151 B1 for cooling objects with different target cooling times. In such a model, the individual treatment stations branch off from a main conveying path. The conveyor system carries each object to the respective treatment station and deposits it there. After sufficient cooling of the object, it is taken back to the conveyor system and transported onwards. In this manner, each object can be treated according to its individual cooling time and then discharged from the cooling area through the use of the conveyor system. However, such a configuration is costly, since for every branch from the main conveyor path to a treatment station, a corresponding separate transporting mechanism is required. In addition, a relatively large installation area is required, since the main conveying path for reaching the individual treatment stations always has to be kept clear. It is true that with such cooling tunnels, objects or batches with widely varying target cooling times can be treated, without individual objects or batches holding up the throughput of the cooling tunnel to any significant extent, or getting cooled for too short a time. However, with homogeneous target cooling times, the throughput of discontinuous cooling tunnels is clearly far less than in the case of the continuous cooling tunnels explained above, since the conveyor system represents a bottleneck.

SUMMARY OF THE INVENTION

It is accordingly an object of the invention to provide a cooling tunnel and a method for operating a cooling tunnel which overcome the above-mentioned disadvantages of the heretofore-known cooling tunnels and methods for operating a cooling tunnel of this general type and which allow a high throughput with variable target cooling times.

With the foregoing and other objects in view there is provided, in accordance with the invention, a cooling tunnel, including:

- an infeed port for feeding objects to be cooled;
- a discharge port for discharging objects;
- a plurality of successive treatment stations for subjecting the objects to be cooled with a cooling medium;
- a conveyor system for transporting the objects to be cooled from the infeed port to the discharge port, the conveyor system running through the individual treatment stations; and
- the conveyor system having a first section running through several of the treatment stations, the first section extending from the infeed port to a turnaround station, a second section running through several of the treatment stations, the second section extending from the turnaround station to the discharge port, as well as a return section, which is located before the discharge port and connects a discharge-side zone of the second section with an infeed-side zone of the first section for selectively discharging or further cooling objects.

In other words, according to the invention, there is provided a cooling tunnel, including an infeed port for feeding objects to be cooled, a discharge port for discharging objects, a plurality of successive treatment stations for subjecting the objects to be cooled with a cooling medium, especially cooling air, and a conveyor system for transporting the objects to be cooled from the infeed port to the discharge port, with the conveyor system running through the individual treatment stations, wherein the conveyor system has a first section running through several treatment stations, the first section extending from the infeed port to a turnaround station, a second section running through several treatment stations, the second section extending from the turnaround station to the discharge port, as well as a return section, which is located before the discharge port and connects a discharge-side zone of the second section with an infeed-side zone of the first section, to optionally either discharge objects or to cool them further.

In consequence, objects with widely different target cooling times can be fed in any sequence into the cooling tunnel and cooled for the required target cooling time, without objects with longer target cooling times hindering the throughput of objects with shorter target cooling times. With the first and second section as well as the return section, the conveyor system allows circulation for the objects to be cooled; here, the return section forms a separation point before the discharge port that makes it possible to discharge sufficiently cooled objects, but to continue to cool those objects that have not yet been sufficiently cooled.

The conveyor system can then be controlled in such a way that a feed will not take place until it is necessary for discharging finish-cooled objects or for changing the treatment station.

According to another feature of the invention, the first section and the second section of the conveyor system are arranged next to one another, i.e. alongside one another or parallel to one another, in a common treatment room and discharge zones for feeding cooling medium to the individual treatment stations are arranged on opposite side walls of the treatment room. This allows a compact construction as well as an efficient deployment of the cooling medium. In addition, it is not necessary to rotate the objects to be cooled around their vertical axis for subjecting them to the cooling medium from opposite sides. Expensive turntables on the conveyor path can thus be left out. Sections bordering each other with opposite blowing directions, which result in flow losses or would require delimitation between one another, are also avoided.

Preferably, an air exhaust is arranged between the first section and the second section of the conveyor system such that an exhaust of air takes place between the first and the second section of the conveyor system, as a result of which a good air throughput is achieved at the objects to be cooled, and hence, a good cooling effect.

In principle, the second section of the conveyor system can be directly connected to the first section of the conveyor system at the turnaround station; if required, suitable devices can be provided to retain the original alignment of the objects to be cooled. However, according to an advantageous embodiment of the invention, there is arranged, at the turnaround station, a transfer device for transferring objects from the first section of the conveyor system to the second section of the conveyor system, which allows a parallel arrangement of the first and second section at a small distance. Thus, the footprint of the cooling tunnel remains small.

Moreover, the first section and the second section of the conveyor system can have separately drivable sub-zones; at the end of every sub-zone of the first section, there is a transfer device provided for transferring objects to the second section. Consequently, different conveying paths can be implemented in the cooling tunnel. Through the use of additional transfer devices between the first and second section, certain shortcuts are provided, via which objects with shorter remaining cooling times can overtake those with longer remaining cooling times. This enables a high degree of flexibility, which in turn facilitates achieving a high throughput while narrow tolerances with respect to the target cooling times can be complied with.

Preferably, separately controllable outflow zones for feeding cooling medium are provided in the sub-zones. This makes it possible to adjust the cooling tunnel to varying throughput quantities. Thus, for example, with small throughput quantities, sub-zones can be switched off and accordingly, energy can be saved. This is further facilitated by the arrangement of the sub-zones in separate treatment rooms, which are separated from one another by bulkhead walls. Moreover, it is possible to implement different cooling processes through the use of an air technology that is separate for each sub-zone.

According to another advantageous embodiment of the invention, the first section of the conveyor system has, in at least one sub-zone adjacent to the inflow port, for every treatment station, an individually controllable single-station drive. In this manner, the objects to be cooled can be stacked, i.e. held back, in this zone and conveyed onwards only if required. As a result, the number of product movements can be reduced. In addition, in this manner, at low throughput quantities, especially in the case of a cooling tunnel made up of several sub-zones, the energy efficiency can be optimized by switching off superfluous sub-zones by concentrating on the inflow and discharge side sub-zones.

The cooling tunnel according to the invention preferably further includes a control device for controlling the individual sections of the conveyor system as well as any sub-zones of the sections that may exist. The control device is configured in such a way that every object that is fed is assigned a time account for the required target cooling time. The position of any object can be determined through the use of the cooling time account and the actuation of the conveyor system. If it is found in the control device that an object is located before the return section, a check is carried out whether its cooling time account has run out. If that is the case, the relevant object is discharged by actuating the second section. Otherwise, the object is transferred to the first section of the conveyor system by actuating the return section. Thus, a fully automatic operation of the cooling tunnel is achieved.

According to another feature of the invention, respective dwell times for respective different feed directions of cooling medium are recorded in the cooling time account.

According to another feature of the invention, at least a further turnaround station is provided, the control device being configured such that, upon acquisition of an object before or at one of the turnaround stations, a decision logic stored in the control device is used to check whether the object should be transferred to the second section or should remain in the first section. Thus, if there are several turnaround stations, it is possible to further determine, through the use of the control device, whether the conveying path should be shortened for a particular object. In this case, the control device transmits a corresponding signal to the relevant transfer device. For this purpose, there is a suitable decision logic stored in the control device, with which a check is carried out whether the object should be transferred to the second section or remain in the first section.

According to another feature of the invention, the treatment stations are configured to operate with cooling air as the cooling medium.

With the objects of the invention in view there is also provided, a cooling tunnel, including a treatment room that is separate from an outside environment; an infeed port for feeding objects to be cooled into the treatment room; a discharge port for discharging objects out of the treatment room; a plurality of successive treatment stations within the treatment room for subjecting the objects to be cooled with a cooling medium; a conveyor system for transporting the objects to be cooled from the infeed port to the discharge port, the conveyor system running through the individual treatment stations; and the conveyor system having a first section running through several of the treatment stations, the first section extending from the infeed port to a turnaround station, a second section running through several of the treatment stations, the second section extending from the turnaround station to the discharge port, as well as a return section within the treatment room, the return section being located before the discharge port and connecting a discharge-side zone of the second section with an infeed-side zone of the first section for selectively discharging or further cooling objects.

With the objects of the invention in view there is further provided, a method for operating a cooling tunnel that includes the steps of:

providing a cooling tunnel having an infeed port, a discharge port and a circulation conveyor system running through successive treatment stations;

transferring objects with respective different target cooling times via the infeed port to the circulation conveyor system;

assigning a respective cooling time account with a respective target cooling time to every object;

recording an elapsed dwell time in the cooling tunnel; and deciding, at a position before the discharge port, based on the cooling time account, whether an object is to be discharged via the discharge port or to remain in the circulation conveyor system.

In other words, according to the invention, there is provided a method for operating a cooling tunnel that is especially suited for operating the cooling tunnel explained above. The method according to the invention relates to a cooling tunnel having a circulating conveyor system running through consecutive treatment stations and having an infeed port and a discharge port. According to the invention, objects with different target cooling times are transferred via the infeed port to the circulating conveyor system. A time account with a target cooling time is assigned to each object, in which the cumulative dwell time in the cooling tunnel is recorded. If an object reaches a position before the discharge port, the cooling time account is used to decide whether the object is to be ejected through the discharge port or is to remain on the circulation conveyor system. If the target cooling time elapses during the dwell time in the cooling tunnel, discharge of the relevant object is initiated, with any preceding objects, the target cooling time of which has not yet elapsed, being moved past the discharge port.

According to an advantageous embodiment of the method, the dwell times for different feed directions of the cooling medium are recorded separately in the cooling time account. A more uniform cooling can thus be achieved.

Another mode of the invention includes providing the circulation conveyor system of the cooling tunnel with at least one short-cut branch for shortening a conveying path; and deciding, based on cooling time accounts of several objects, whether or not an object is to go through the short-cut branch. If the circulation conveyor system has at least one branch for shortening the conveying path, the method according to the invention can be modified in such a way that based on the cooling time accounts of several objects, a decision is made whether the object goes through the short-cut or not. In this manner, objects with a shorter target cooling time can be passed faster through the cooling tunnel, whereas at least some of the objects with higher remaining cooling times do not need to be moved, or at least moved less often.

Another mode of the invention includes the steps of providing the circulation conveyor system of the cooling tunnel with at least one short-cut branch for shortening a conveying path; recording respective dwell times for different feed directions of cooling medium in the cooling time account; and deciding, based on cooling time accounts of several objects, whether or not an object is to go through the short-cut branch.

As already explained above, it is, moreover, possible to stack up or retain objects in a first section of the conveyor system.

Other features which are considered as characteristic for the invention are set forth in the appended claims.

Although the invention is illustrated and described herein as embodied in a cooling tunnel and a method for operating a cooling tunnel, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

The exemplary embodiments depicted in the figures refer to a cooling tunnel 1 for cooling objects 10 like dairy products and the like through the use of a cooling medium. Normally, the objects 10 are stacked on pallets 11, which are subject to a flow of cooling air at different treatment stations within the cooling tunnel 1.

Figure 1A:
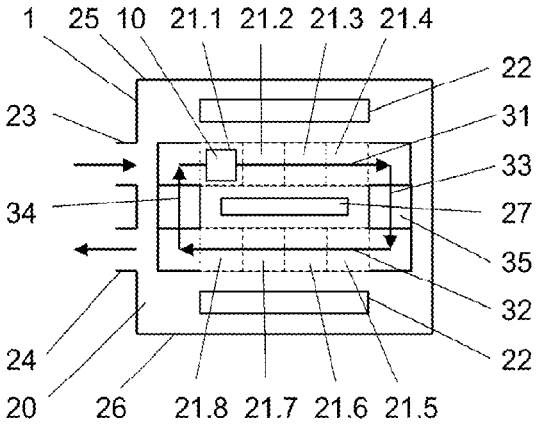
FIG. 1*a* is a schematic view of a first exemplary embodiment of a cooling tunnel according to the invention.

The cooling tunnel 10 shown in FIG. 1*a* has a treatment room 20 that is separated from the outside environment. Within the treatment room 20, there are several consecutive treatment stations 21.1 to 21.8, past which the objects 10 stacked on pallets 11 are transported through the use of a conveyor system 30. At the treatment stations 21.1 to 21.8, there are outflow zones 22 for treating the objects to be cooled 10 with cooling medium.

Figure 1B:
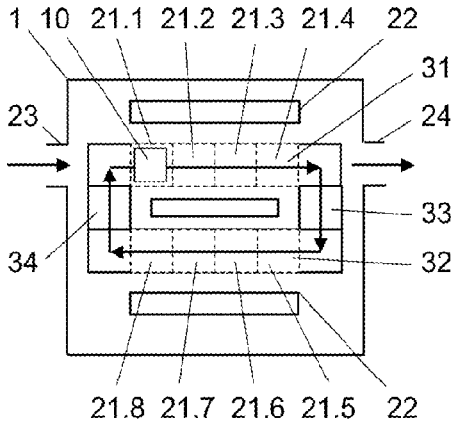
FIG. 1*b* is a schematic view of a second exemplary embodiment of a cooling tunnel according to the invention.

Objects to be cooled are introduced into the treatment room 20 through an infeed port 23 and transferred to the conveyor system 30. Moreover, a discharge port 24 is provided, through which the objects 10 are moved out of the cooling tunnel 1 after their treatment with cooling medium. The conveyor system 30 is arranged in such a way that it runs through the consecutive treatment stations 21.1 to 21.8, as a result of which, in the case of the exemplary embodiment shown in FIG. 1, every object to be cooled 10 runs through all the treatment stations 21.1 to 21.8. However, this does not automatically mean that every object to be cooled 10 has to remain at every treatment station 21.1 to 21.8 for the same interval of time. Rather, the feed of the conveyor system 30 can be adjusted flexibly so that different dwell times are set for the objects 10 at the individual treatment stations, as will be shown in more detail further below.

The conveyor system 30 has a first section 31 and a second section 32, which are delimited from one another by the turnaround station 33. Every section goes through several treatment stations 21.1 to 21.4 and, respectively, 21.5 to 21.8. While the first section 31 extends from the infeed port 23 to the turnaround station 33, the second station 32 extends from the turnaround station 33 up to the discharge port 24. The two sections are arranged parallel to one another in the exemplary embodiment shown, but have oppositely directed conveyor systems, so that the infeed port 23 and the discharge port 24 are next to each other. In the variant shown in FIG. 1*b*, the infeed port 23 and the discharge port 24 are located at opposite ends of the cooling tunnel 1. However, on the basis of the circulation conveyance principle of the conveyor system 30, the arrangement of the ports 23 and 24 can be, for example, at an angle towards each other as well. In addition, if required, more than two ports 23 and 24 altogether can be provided.

Moreover, the conveyor system 30 has a return section 34. It is arranged immediately before the discharge port 24 as well as after the last treatment station 21.8 of the second section 32 and if required, allows a transfer of objects 10 from the second section 32 to the first section 31. In this manner, objects 10 can be optionally, i.e. selectively, discharged or cooled further. The section can, for example, be configured as a driven roller conveyor with rollers that can be raised and lowered, so that depending on their position, an object that has been brought in on the second section 32 can be captured and branched either to the first section 31 or to the discharge port 24.

At the turnaround station 33, there is a transfer device 35 for transferring objects 10 from the first section 31 of the conveyor system to the second section 32 of the conveyor system. The transfer device 35 can be configured as a roller conveyor with driven rollers that is arranged transversely to the sections 31 and 32. Transferred objects 10 or pallets 11 with such objects thus retain their original direction when transferred from the first section 31 to the second section 32.

Since the outflow zones at 21.1 to 21.4 assigned to the first section 31 as well as the outflow zones at 21.5 to 21.8 assigned to the second section 32 are arranged on opposite side walls 25 and 26 respectively of the treatment room 20 parallel to the two sections 31 and 32 of the conveyor system 30, the objects 10 are subject to a flow of cooling medium from opposite sides during the transport through the treatment room 20. This makes the cooling behavior uniform.

By arranging an air exhaust 27 between the first and second section 31 and 32 of the conveyor system 30, a good flow through and between the product batches arranged on the pallets 11 is ensured.

Figure 2:
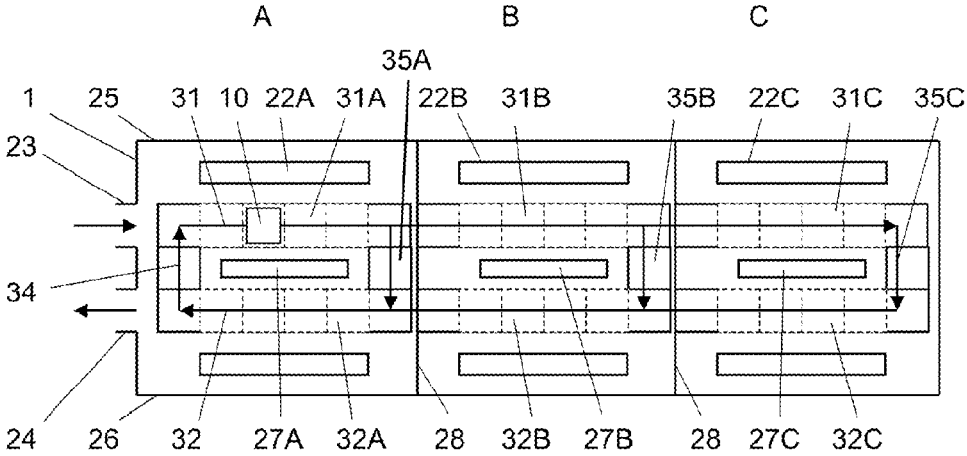
FIG. 2 is a schematic view of a third exemplary embodiment of a modified cooling tunnel with several sub-zones according to the invention.

The base unit A shown in FIG. 1*a* with an infeed port 23, a discharge port 24 as well as a conveyor system 30 having a turnaround station 33 and a return section 34 can be supplemented with additional units B and C, an example of which is shown in FIG. 2. Each of the other units B and C in turn includes a conveyor system 30, which has at least one turnaround station with a transfer device 35B, 35C for transferring objects from the first section 31B, 31C to the second section 32B, 32C. In a modification of the depiction in FIG. 2, an additional return section may be provided at the additional units, which facilitates a transfer from the second section 32B, 32C to the first section 31B, 31C. Alternatively, with the exception of the last transfer device 35C, i.e. the one that is farthest from the infeed port 23, all transfer devices 35A, 35B can be configured to be bidirectional, i.e. allow back-and-forth transport between the first and second section 31A, 31B and 32A, 32B. In this manner, for different objects 10, different conveying paths can be realized within the cooling tunnel 1, for example, to realize variable target cooling times at high throughput rates or to be able to carry out different cooling processes. For this purpose, the flow zones 22A, 22B, 22C at the treatment stations of the units A, B and C can be individually operated and/or controlled. Air exhausts 27A, 27B, 27C are provided between the respective first and second sections 31A, 31B, 31C and 32A, 32B, 32C. Bulkhead walls 28 between the individual units A, B and C facilitate an individual operation in the correspondingly formed chambers or treatment rooms of the units, including a temporary shut-off of one or both of the additional chambers B and C.

A total of three units, A, B and C are shown in FIG. 2. However, a larger or a smaller number can be selected. In particular, the additional units B and C can have the same construction. By adding more units, the maximum throughput quantity of the cooling tunnel 1 can be increased. If required, one base unit A with an infeed port 23 and a discharge port 24 each can be provided at both ends of the cooling tunnel 1.

Figure 3:
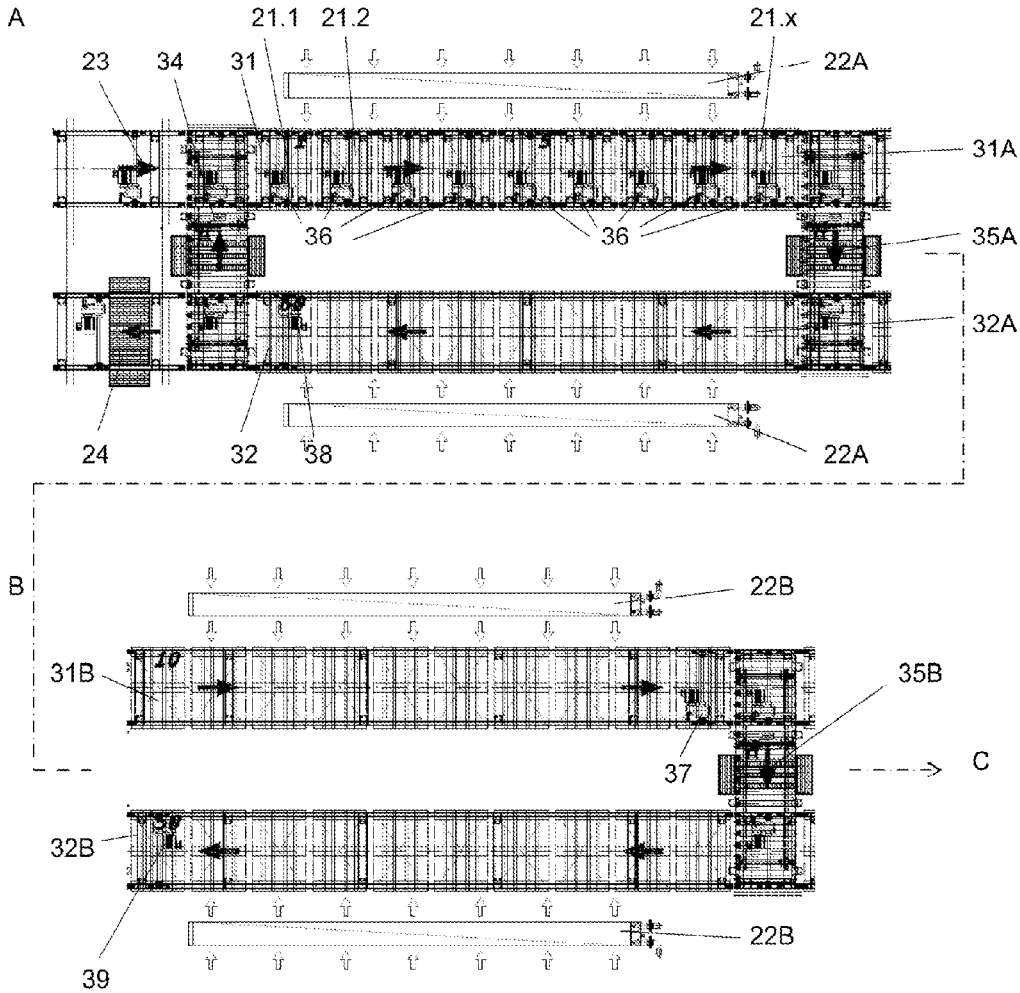
FIG. 3 is a diagrammatic top view of the conveyor system of a cooling tunnel according to FIG. 2 in accordance with the invention.

FIG. 3 shows the conveyor system 30 in top view; for reasons of clarity, only one base unit A and another unit B have been shown here. The first section 31 of the conveyor system is divided according to the sectionalization of the cooling tunnel 1 into the units A and B, in separately drivable sub-zones 31A and 31B. Sub-zone 31A has, for every treatment station 21.1 to 21.*x*, a individually controllable single-station drive 36, so that the objects 10 can be transported forward individually in a zone that directly borders the infeed port 23 and the return section 34. As against that, in sub-zone 31B, a chain conveyor with a central drive 37 is provided. In the sub-zones 32A and 32B too, one chain conveyor each with a central drive 38 or 39 is used. Alternatively, in the sub-zone 31A, too, instead of the single-station drives 36, a chain conveyor with a central drive can be provided, as is the case in the other sub-zones.

Figure 4:
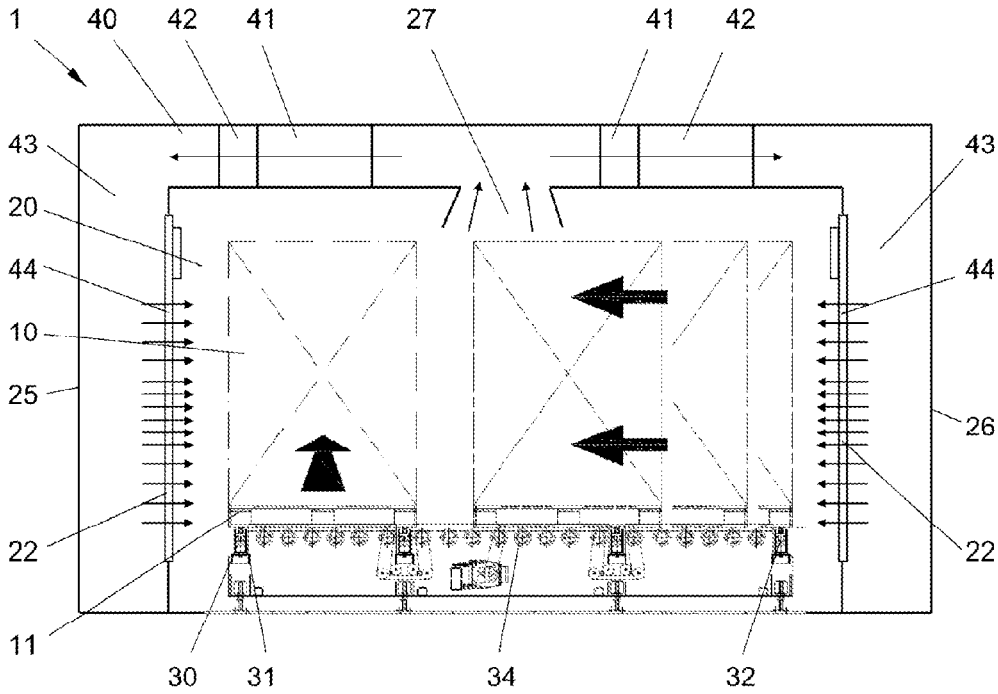
FIG. 4 is a diagrammatic sectional view transverse to the conveying direction of a first and second section of the conveyor system of the cooling tunnel according to FIG. 3 in accordance with the invention.

FIG. 4 shows a section through the cooling tunnel 1 transverse to the direction of transport of the first and second section 31 and 32 for illustrating the supply and circulation of the cooling medium. As has already been mentioned above, the cooling medium is provided through the flow zones 22 at the sides. The pressure can be supplied centrally or in a decentralized manner. Preferably, each unit A, B and C has its own pressure supply device 40. However, in a simplified embodiment, a single pressure supply device 40 with a central pressure generator can be provided for all units A, B and C.

Every pressure supply device 40 includes one or more fans 41, through which the air is sucked up from the treatment room 20 and fed into the pressure chambers 43 through one or more coolers 42. The pressure chambers 43 supply a defined air stream in each case to several treatment stations 21.1. to 21.*x* via nozzle plates 44 for cooling the objects 10 that are located there. As can be seen from FIG. 4, two pressure chambers 43 with the corresponding nozzle plates 44 are located on the exterior next to the sections 31 and 32 of the conveyor system. Used cooling air is sucked upwards between the sections 31 and 32. A downward exhaust is also possible.

Through the use of the cooling tunnel 1 explained above, objects 10 with widely different target cooling times can be processed; owing to the high system flexibility, a high throughput is achieved, whereas deviations from the target cooling times remain low. In particular, with the cooling tunnel 1 explained above, it can be avoided that objects 10 with high target cooling times reduce the throughput of objects 10 with low target cooling times, when both are to be cooled for at least the target cooling time.

Cooling tunnel 1 can be operated fully automatically through the use of a control device; here, objects 10 with different target cooling times can be brought via the infeed port 23 into the treatment room 20 in any sequence and at any time.

The control device facilitates, firstly, individual control of the individual sections 31, 32, 34 and 35 of the conveyor system 30 as well as existing section sub-zones 31A, 31B, 31C, 32A, 32B and 32C if applicable.

Moreover, the control device is configured in such a way that every object that is fed is assigned a time account for the required target cooling time. Through the use of a decision logic that is stored in the control device, the feed of the introduced objects 10 is coordinated or synchronized by controlling the individual sections of the conveyor system, in order to realize the target cooling times while avoiding noticeable overshooting. In the controller, if it is found for an object 10 that its cooling time account is running out, then based on the cooling time account and the actuation of the conveyor system in the meantime, the position of the object 10 is determined and by actuating the relevant sections of the conveyor system 30, the object is transported in the direction of the discharge port 24.

Here, it may happen that there are other objects 10 with a higher remaining cooling time before the respective object 10. To avoid a premature discharge of those objects, when an object 10 is acquired in front of the return section 34, a check is run whether its cooling time account has run out. If this is the case, the respective object 10 is discharged by actuating the second section 32. Otherwise, the respective object 10 is transferred to the first section 31 of the conveyor system 30 by actuating the return section 34, so that it can be cooled further.

In case of a configuration with several turnaround stations 33, as shown in FIGS. 2 and 3, actuation of the transfer devices 35 located there is integrated in the control in such a manner that for example, upon acquisition of an object 10 before or at one such station, a decision logic embedded in the control device is used to check whether the object 10 should be transferred to the second section 32 or should continue to remain in the first section 31. Through actuation of a transfer device 35, which is not the transfer device 35C that is located farthest from the infeed port 23, the conveyor path for an object 10 can be shortened individually. In this manner, objects with higher remaining cooling times can, for example, be passed or overtaken, so that the conveyor path for these remains short and unnecessary detours or circulations are not initiated.

Figure 5:
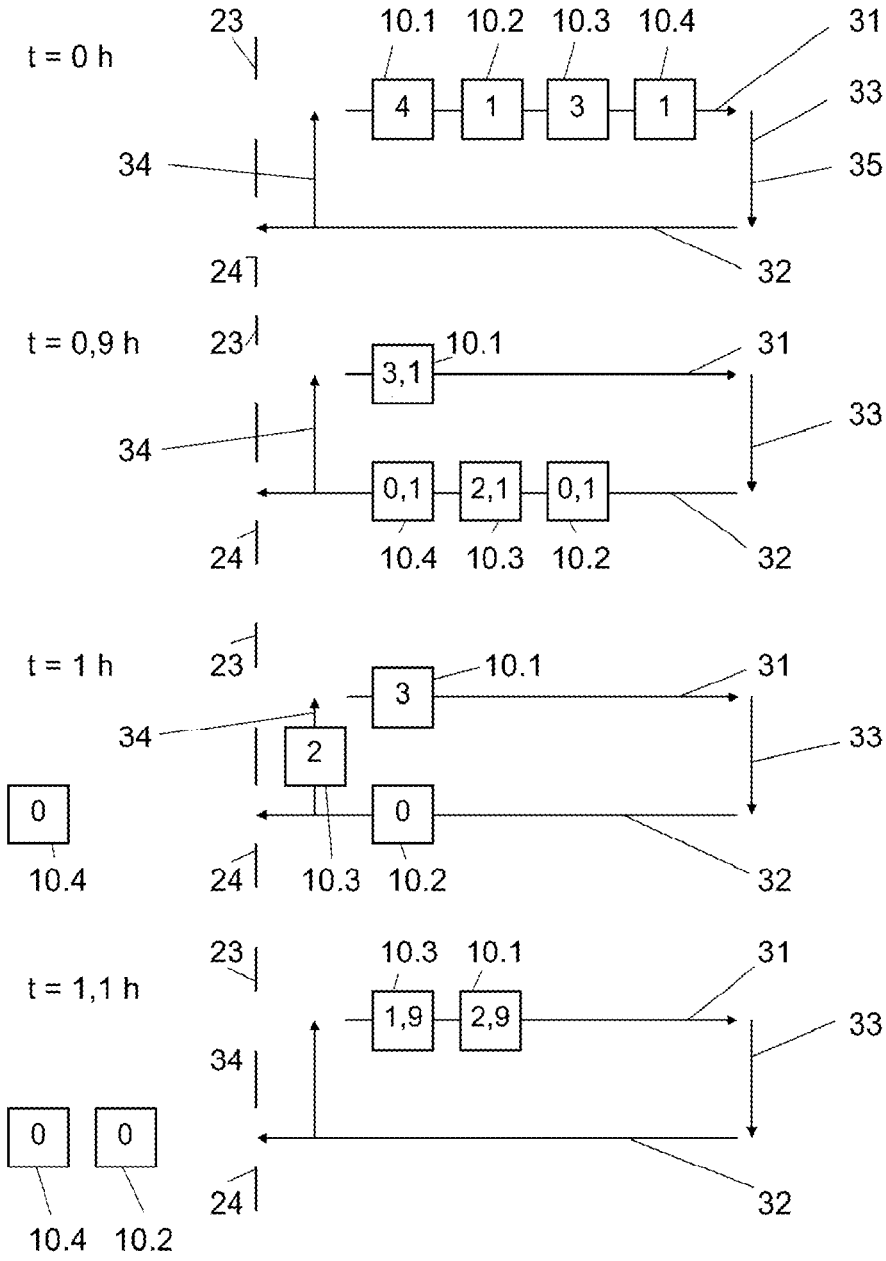
FIG. 5 is a schematic diagram for illustrating the process sequence of the method according to the invention.

FIG. 5 is solely intended to depict by way of example only, a possible process flow for operating a cooling tunnel 1 or a pallet cooling system with a circulation conveyor system 30 that runs through successive treatment stations, as well as an infeed port 23 and a discharge port 24. The positions of the individual objects 10.1 to 10.4 are depicted in FIG. 5 for different times t, with the remaining cooling time in hours being given on every object.

At time t=0 h, four objects 10.1 to 10.4 with different remaining cooling times are located in stacked arrangement in the zone of the first section 31 adjacent to the infeed port 23.

At time t=0.9 h, it is determined that for the objects 10.2 and 10.4, the target cooling time will run out shortly, so that they should be discharged. The control device initiates an actuation of the relevant sections 31, 35 and 32, in order to transport the mentioned objects in the direction of the discharge port 24. The object 10.1 can remain in its treatment station at this time. However, object 10.3 must be transported along in any case, so that the following object 10.2 with a shorter remaining cooling time does not remain in cooling tunnel 1 for an unnecessary period of time. If a chain conveyor is used in section 31 instead of single station conveyors, the object 10.1 is carried along at least up to the turnaround station 33. Naturally, all the objects 10.1 to 10.4 can be transported en bloc up to the return section 34.

Before the transported objects reach the discharge port 24, a check is carried out with the help of the cooling time account for every transported object 10.2, 10.3 and 10.4 before the return section 34, whether the target cooling time has been reached. At time t=1 h, this is the case for the object 10.4, so that it is discharged. The next object 10.3 has a remaining cooling time of 3 hours at this time, so that it is transferred to the first section 31 through the use of the return section 34. To do so, if required, the object 10.1 located there must be advanced further. The other object 10.2, whose target cooling time has been reached is also discharged at time t=1 h.

Thus, at time t=1.1 h, only the objects 10.3 and 10.1 with remaining cooling times 1.9 h and 2.9 h remain in the first section 31. If no new objects are fed, a feed of the conveyor system 30 will not take place until the remaining objects 10.3 and 10.1 are to be subject to cooling air from the opposite side, or discharged.

The cooling tunnel explained above allows a high throughput in case of variable target cooling times and compliance with them in a narrow tolerance range. The conflict of goals in the prior art is thus eliminated.

The invention has been explained in detail above with the help of an exemplary embodiment. However, the invention is not limited to this example, but comprises all the embodiments defined in the accompanying claims.

The invention claimed is:

1. A cooling tunnel, comprising:

an infeed port for feeding objects to be cooled;

a discharge port for discharging objects;

a plurality of successive treatment stations for subjecting the objects to be cooled with a cooling medium;

a conveyor system defining a path of transport through said treatment stations for transporting the objects to be cooled from said infeed port to said discharge port;

wherein said conveyor system has a first section extending from said infeed port to a turnaround station, said first section running through several of said treatment stations that are arranged in series along said path of transport, a second section extending from said turnaround station to said discharge port in parallel to said first section, said second section running through several of said treatment stations that are arranged in series along said path of transport, and a return section located before said discharge port and connecting a discharge-side zone of said second section with an infeed-side zone of said first section for selectively discharging or further cooling objects; and a control device for controlling said first section, said second section and said return section of said conveyor system, said control device being configured such that a cooling time account for a required target cooling time is assigned to every introduced object, wherein a position of an object can be determined depending on the cooling time account and an actuation of said conveyor system, wherein, upon acquisition of a respective object before said return section, a check is carried out whether the respective cooling time account has run out and, if that is the case, the respective object can be discharged by actuating said second section and, if that is not the case, the respective object can be transferred to said first section of said conveyor system by actuating said return section.

2. The cooling tunnel according to claim 1, wherein said first section and said second section of said conveyor system are arranged in a common treatment room with the treatment stations of the first section arranged alongside the treatment stations of the second section and wherein discharge zones for feeding cooling medium to the treatment stations of the first section and discharge zones for feeding cooling medium to the treatment stations of the second section are arranged on opposite side walls of said treatment room, respectively.

3. The cooling tunnel according to claim 1, including an air exhaust arranged between said first section and said second section of said conveyor system.

4. The cooling tunnel according to claim 1, wherein, at said turnaround station, a transfer device is arranged for transferring objects from said first section of said conveyor system to said second section of said conveyor system.

5. The cooling tunnel according to claim 1, wherein said first section and said second section of said conveyor system have separately drivable sub-zones and, at a respective end of each respective one of said sub-zones of said first section, a respective transfer device is provided for transferring objects to said second section.

6. The cooling tunnel according to claim 5, including separately controllable outflow zones assigned to said sub-zones for feeding cooling medium.

7. The cooling tunnel according to claim 5, wherein said sub-zones are located in separate treatment rooms, which are separated from one another by bulkhead walls.

8. The cooling tunnel according to dam 5, wherein a given one of said sub-zones borders said infeed port, and, in at least said given one of said sub-zones, said first section of said conveyor system has a respective individually controllable single-station drive for each respective one of said treatment stations.

9. The cooling tunnel according to claim 1, wherein respective dwell times for respective different feed directions of cooling medium are recorded in the cooling time account.

10. The cooling tunnel according to claim 1, including at least a further turnaround station, said control device being configured such that, upon acquisition of an object before or at one of said turnaround stations, a decision logic stored in said control device is used to check whether the object should be transferred to said second section or should remain in said first section.

11. The cooling tunnel according to claim 1, wherein said treatment stations are configured to operate with cooling air as the cooling medium.

12. The cooling tunnel according to claim 1, wherein said control device controls sub-zones of at least one of said first section and said second section.

13. A cooling tunnel, comprising:

a treatment room that is separate from an outside environment;

an infeed port for feeding objects to be cooled into said treatment room;

a discharge port for discharging objects out of said treatment room;

a plurality of successive treatment stations within said treatment room for subjecting the objects to be cooled with a cooling medium;

a conveyor system defining a path of transport through said treatment stations for transporting the objects to be cooled from said infeed port to said discharge port;

wherein said conveyor system has a first section extending from said infeed port to a turnaround station, said first section running through several of said treatment stations that are arranged in series along said path of transport, a second section extending from said turnaround station to said discharge port in parallel to said first section, said second section running through several of said treatment stations that are arranged in series along said path of transport, and a return section within said treatment room, said return section being located before said discharge port and connecting a discharge-side zone of said second section with an infeed-side zone of said first section for selectively discharging or further cooling objects; and a control device for controlling said first section, said second section and said return section of said conveyor system, said control device being configured such that a cooling time account for a required target cooling time is assigned to every introduced object, wherein a position of an object can be determined depending on the cooling time account and an actuation of said conveyor system, wherein, upon acquisition of a respective object before said return section, a check is carried out whether the respective cooling time account has run out and, if that is the case, the respective object can be discharged by actuating said second section and, if that is not the case, the respective object can be transferred to said first section of said conveyor system by actuating said return section.

14. A method for operating a cooling tunnel, the method which comprises:

providing the cooling tunnel with an infeed port, a discharge port and a circulation conveyor system running through successive treatment stations;

transferring objects with respective different target cooling times via the infeed port to the circulation conveyor system;

assigning, in a control device, a respective cooling time account with a respective target cooling time to every object;

recording, in the control device, an elapsed dwell time in the cooling tunnel;

deciding, with the control device, at a position before the discharge port, based on the cooling time account, whether an object is to be discharged via the discharge port or to remain in the circulation conveyor system;

providing the circulation conveyor system of the cooling tunnel with at least one shortcut branch for shortening a conveying path; and deciding, based on cooling time accounts of several objects, whether or not an object is to go through the short-cut branch.

15. The method according to claim 14, which comprises separately recording respective dwell times for different feed directions of cooling medium in the cooling time account.

16. The method according to claim 14, which comprises recording respective dwell times for different feed directions of cooling medium in the cooling time account.

17. The method according to claim 14, which comprises retaining objects in a first section of the circulation conveyor system.

* * * * *